US005868212A

United States Patent [19]

McManus

[11] Patent Number: 5,868,212

[45] Date of Patent: Feb. 9, 1999

[54] STABILISER TOOL

[75] Inventor: Terry Michael McManus, Wingfield, Australia

[73] Assignee: Gearhart Australia Ltd, Malaga, Australia

[21] Appl. No.: 750,287

[22] PCT Filed: Apr. 19, 1996

[86] PCT No.: PCT/AU96/00227

§ 371 Date: Dec. 2, 1996

§ 102(e) Date: Dec. 2, 1996

[30] Foreign Application Priority Data

Aug. 8, 1995 [AU] Australia ..... PN 4693

[51] Int. Cl.[6] ..... E21B 17/10; E21B 17/22

[52] U.S. Cl. ..... 175/325.4; 175/401

[58] Field of Search ..... 175/325.4, 325.5, 175/325.6, 325.7, 401

[56] References Cited

U.S. PATENT DOCUMENTS

| | | | |
|---|---|---|---|
| 2,956,781 | 10/1960 | Eastman | 175/325.4 |
| 3,454,308 | 7/1969 | Kennedy | 175/325.4 |
| 4,254,839 | 3/1981 | Schpok et al. | 175/372 |
| 4,765,417 | 8/1988 | Perkin et al. | 175/347 |
| 4,792,000 | 12/1988 | Perkin et al. | 175/228 |
| 4,986,375 | 1/1991 | Maher | 175/401 X |

*Primary Examiner*—David J. Bagnell

*Attorney, Agent, or Firm*—Watts, Hoffmann, Fisher & Heinke Co., L.P.A.

[57] ABSTRACT

A stabilizer tool (15) for a drill string (10) has a circular body (16) with recesses (17) containing projecting pad assemblies (18) arranged in a spaced helical configuration, each pad assembly (18) having at least one projecting wear block (20) maintained in abutment with an undercut recess surface by a wedge block (21) the outer wear surface (30) being of harder material than the remainder of the blocks (20, 21).

13 Claims, 4 Drawing Sheets

STABILISER TOOL

This invention relates to a stabiliser tool for stabilising operation of a drill string in borehole drilling through the earth's surface.

BACKGROUND OF THE INVENTION

Boreholes are frequently drilled as vertical holes, and prior art provides sufficient technology to frequently achieve continued alignment along a single axis, both when the drilling string penetrates the ground and upon withdrawal.

However difficulties are encountered when boreholes are drilled firstly vertically downwardly, and then curve to an inclined or horizontal direction, and maintaining of complete control is very important but very difficult to achieve. A borehole drill may, for example, comprise three cutters which are circumferentially spaced from one another, and when the drill bit is inclined to the original axis, the space between the cutters can cause erratic or irregular operation in negotiating a curve. This is slightly improved by the use of rotary roller reamers, and the most relevant prior art to this invention known to the Applicant is disclosed in its own two previous inventions, respectively Australian Patent 594885 and Application PM 2305 (PCT/AU94/00691). The former Application disclosed a reamer having a plurality of hard inserts projecting therefrom (or continuous with the outer surface of the reamer in some instances), and the reamer was carried in respective end blocks in a recess in a reamer body. The arrangement for retention of the blocks utilising wedge surfaces was an important aspect of that invention. However even with the improvements which have been disclosed in the above specifications, difficulty is still encountered when the drill bit is required to traverse a curve, particularly upon withdrawal, when the string tends to straighten. The tendency to straighten sometimes causes the drill string to lock into the borehole, whereupon abandonment is unavoidable. This sometimes occurs even when a curve is not intentionally traversed. Since the cost of a drill string is very high, it is the main object of this invention to provide improvements which will make it easier to control a drill string when in a curved portion of a borehole.

BRIEF SUMMARY OF THE INVENTION

In one aspect of this invention, a borehole drill string stabiliser tool has a circular body with recesses containing projecting pad assemblies arranged in a spaced helical configuration, each pad assembly having at least one projecting wear block retained in abutment with an undercut recess surface by a wedge block, the outer wear surfaces of the blocks being of relatively hard material.

In an aforesaid Patent 594885, the bearings for roller reamers were in end blocks in the reamer bodies, and each retention was by means of a wedge block which, on one side, abutted a recess surface spaced from but parallel to a radial plane which contained the axis of rotation of the roller, and on the other side abutted a sloping wall of the end block. While the same arrangement can be used for the stabiliser of this invention, it is much preferred to utilise two projecting wear blocks flanking a central wedge block, opposite side surfaces of each projecting wear block diverging radially inwardly and on one side abutting opposite inwardly converging side surfaces of the central wedge block and on the other side abutting an inwardly diverging wall in the body recess. It will be appreciated that immense forces may be imposed on the projecting wear blocks and these are transmitted to the inwardly diverging recess surfaces, the sloping surfaces locking the blocks in their recesses and resisting tendency for the wear blocks to be removed by compressive forces, turning moments, or both.

Further in the invention, there may be provided hard tipped cutters (for example polycrystallised diamond cutters) projecting outwardly from the projecting wear blocks, and if these are located towards the top end of the stabiliser and above the reamers of a drill string, the wall of a small bore hole will be enlarged upon withdrawal, thereby reducing likelihood of the drill string being jammed and lost in the hole. A negative rake of the cutters will still provide a cutting action, but may be effective in firmly compacting loose earth or rock upon withdrawal and avoid exacerbating the resistance to withdrawal by unnecessarily adding loose material between the cutters and reamers.

There are several advantages in this invention which are not otherwise available in prior art. Firstly, although stabilising blades have been utilised previously, removal and repair has been quite difficult in this invention however it is merely necessary to remove the central wedge block between two projecting wear blocks, the central block then coming away quite easily and the wear blocks being movable towards one another to come away from the recess walls, also quite easily.

The helical or spiral pattern of the wear blocks ensures that the drill stem upwardly of the reamers remains centralised, and during drilling, being above reamers (when used) the blocks will engage borehole surfaces which are more regular both in size and in smoothness than would exist if the reamers were not present. The stiffness below the stabiliser body of a reamer body and the bit assembly does much to avoid the difficulties previously encountered due to the spacing between the bits and the bit assembly, and thereby much improves the ability of an operator to control the direction of the bit movement.

In addition, the use of separate pads allows a better "flow-by" of debris as the hole is being bored.

BRIEF DESCRIPTION OF THE DRAWINGS

Two embodiments of the invention are described hereunder in some detail with reference to and are illustrated in the accompanying drawings, in which.

Figure 1:
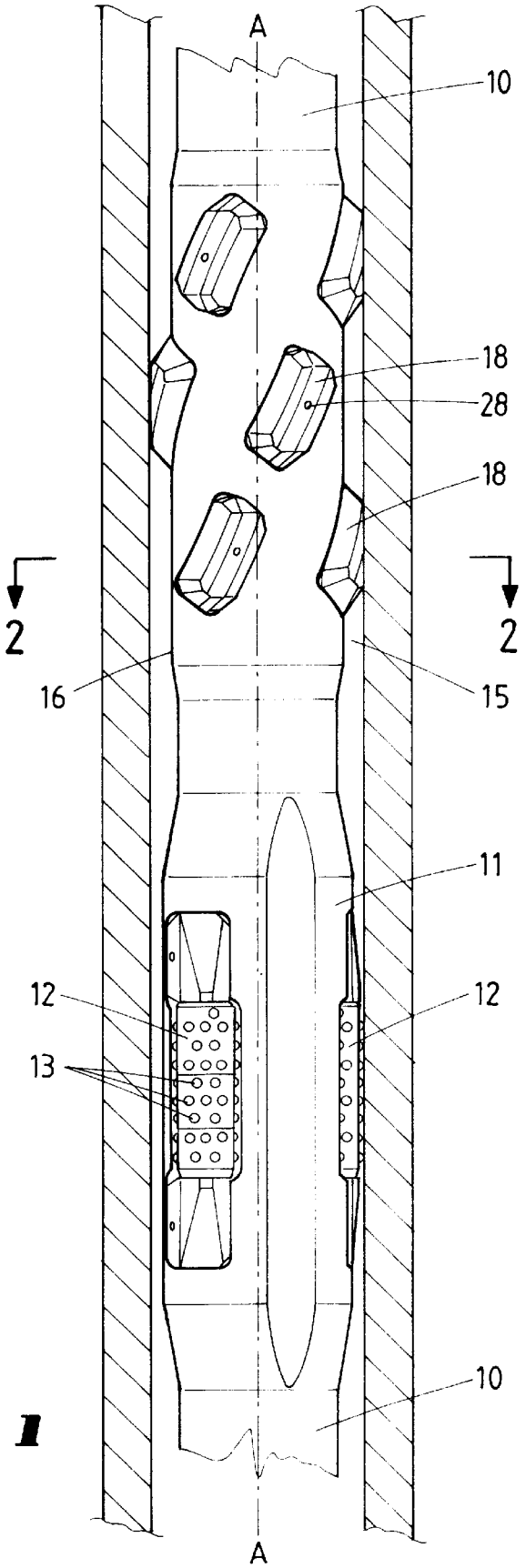
FIG. 1 is a fragmentary elevation which illustrates a reamer of a drill string surmounted by a drill bit stabiliser tool, according to a first embodiment.

In this embodiment, a drill string 10 is provided with a bit assembly (not shown), and that is surmounted by a roller reamer 11 having three rollers 12 each with hard inserts 13 which may project or be flush with the outer surfaces of the rollers.

Above the roller reamer 11 there is provided the stabiliser tool 15 of this invention. Stabiliser tool 15 comprises a generally cylindrical body 16 rotatable about axis A—A, and which has (in this embodiment) three helical rows of recesses 17 (FIG. 2), the side walls of recesses 17 diverging radially inwardly by an included angle of 4'. That angle is a "self-locking" angle and provides abutment surfaces for side walls of wear pad assemblies 18.

Each wear pad assembly 18 comprises three blocks, the two outer blocks 20 being projecting wear blocks, having side walls which diverge by the same 4° angle, and which abut the side walls of recesses 17, and they are held into firm abutment by a central wedge block 21 which has outer side walls which converge radially inwardly by the same 4° included angle, and these match the inner side walls of the wear pad outer blocks 20, and the central block 21 is urged inwardly and locked in place by a socket head bolt 22.

The underside of the head of bolt 22 bears against a U-shaped washer 23 which allows the bolt to be positioned in the central wedge block 21, and the axially outer surface of the head of bolt 22 bears against an abutment surface 24, being an outer surface of a lateral slot 25 which contains washer 23 within the central block 21. There is an opening at 28 to allow access for a key to engage in a recess in the head of bolt 22, both for tightening the wedge block 21 into position and also for releasing the wedge block 21 so that the projecting wear blocks 20 can be removed from their respective recesses.

Each of the wear blocks 20 and 21 is provided with a hard metal surface 30, harder than the remainder of the block.

Figure 2:
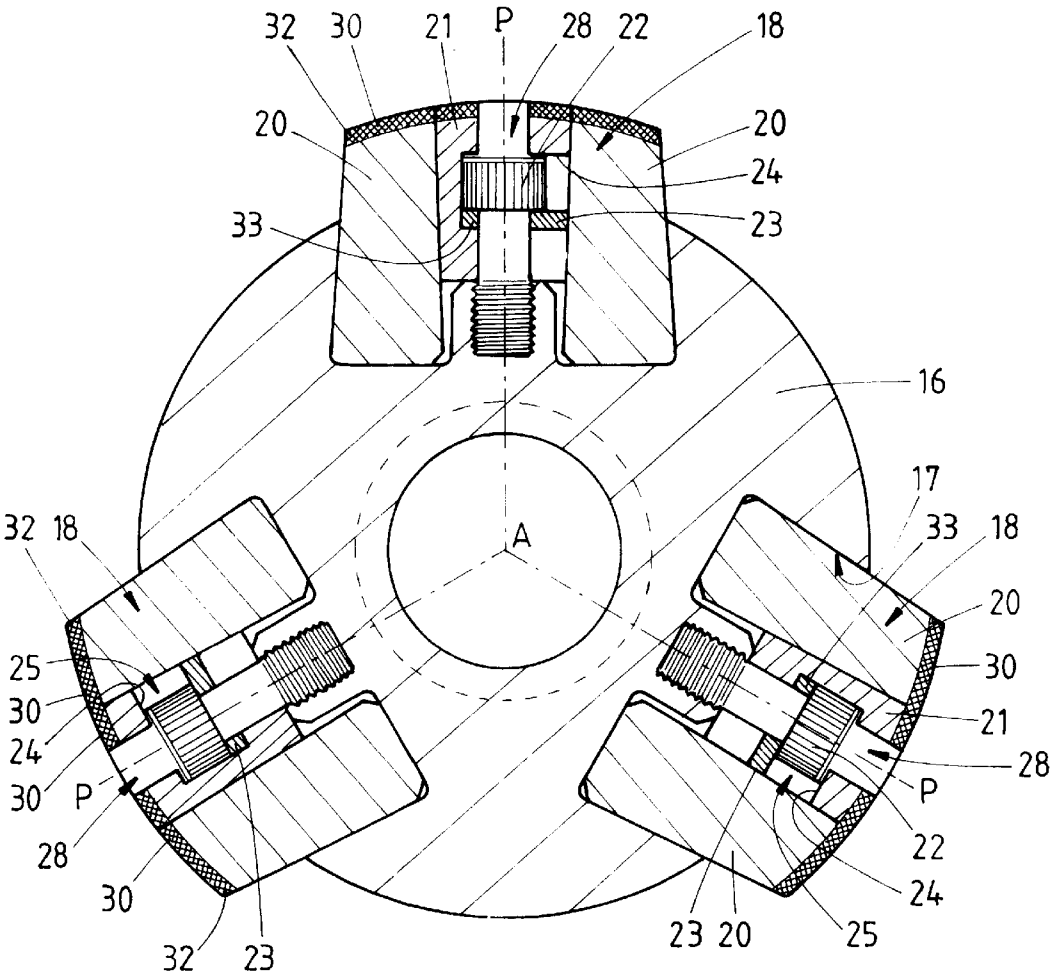
FIG. 2 is a cross-section taken on line 2—2 of FIG. 1, drawn to a larger scale.

As can be seen from FIG. 2, the walls of the recesses 17 in this embodiment are symmetrical about a central radial plane marked AP in FIG. 2, although the outer hard surface 30 need not be symmetrical as described below.

Figure 3:
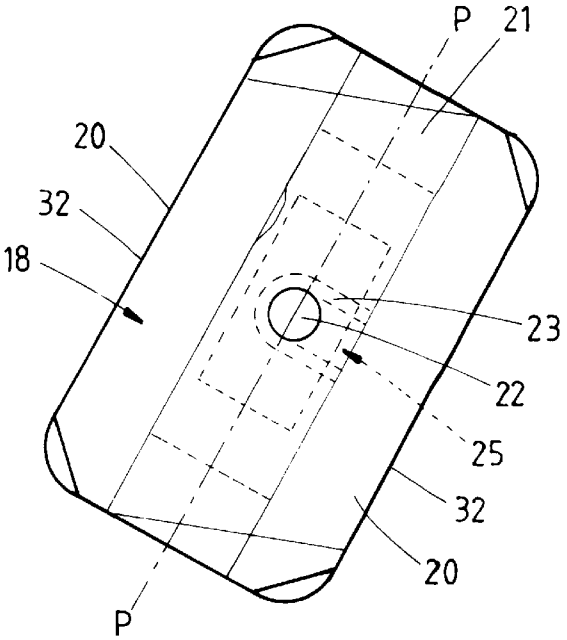
FIG. 3 is a front elevation of a pad assembly.

FIG. 3 shows the plane PP which is central with respect to the socket head bolt 22, and the side edges 32 are parallel to that plane. As shown in FIG. 3, viewed in elevation the pad assembly 18 is approximately rectilinear (except for its corners) but as seen in FIG. 1, in other views it is not.

When assembled, the bolt 22 bearing against the washer 23, urges the wedge block radially inwardly, since the washer 23 abuts the inner surface 33 of the slot 25, so that rotation of the socket head bolt 22 in one direction will cause the wedge block 21 radially inwardly, but in the opposite direction the head of bolt 22 will abut the surface 24 and withdraw the wedge block. Once the wedge block is withdrawn, the bolt 22 along with its U-shaped washer 23 can be moved outwardly away from the wedge block through the lateral slot 25.

Figure 4:
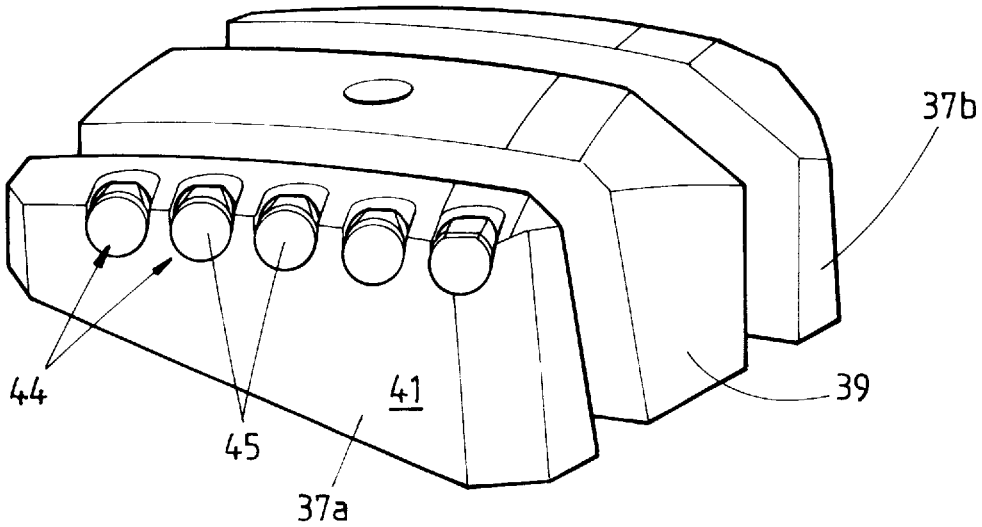
FIG. 4 is a perspective exploded view of a pad assembly according to a second embodiment.
Figure 5:
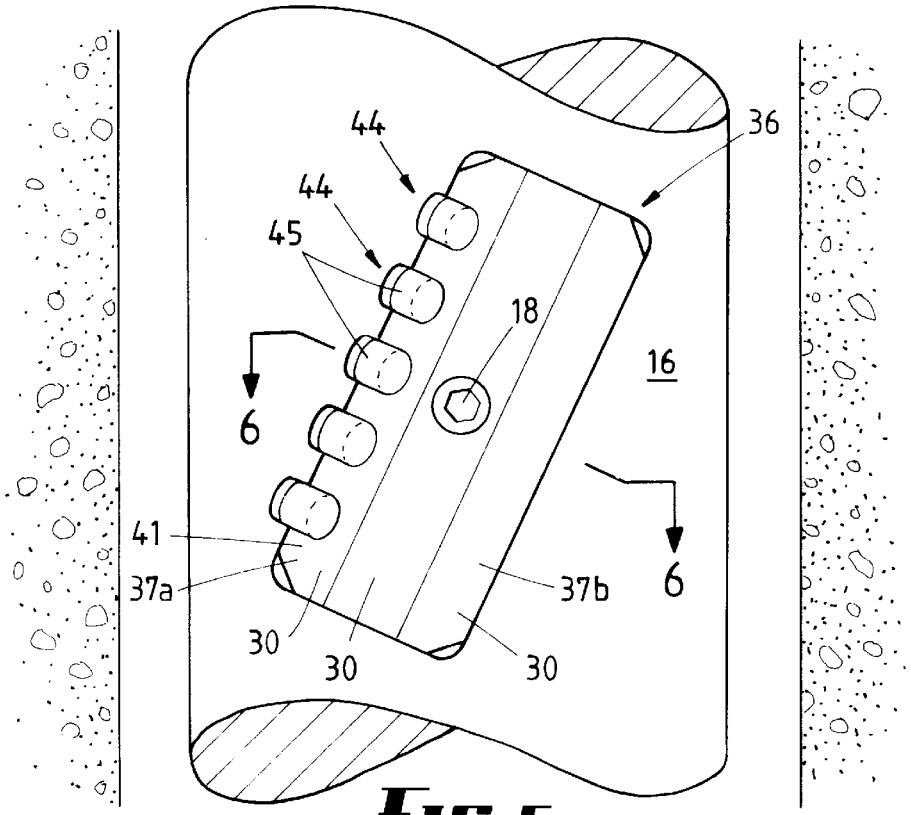
FIG. 5 is a front view of the pad assembly of FIG. 4.
Figure 6:
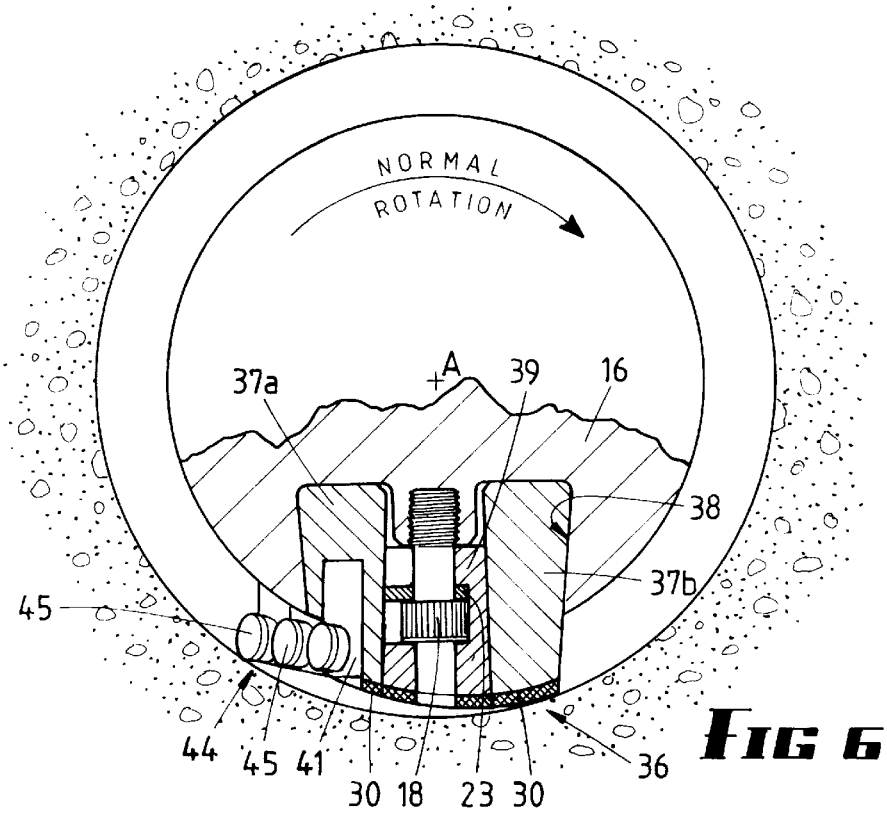
FIG. 6 is a fragmentary section taken on line 6—6 of FIG. 5.

Reference is now made to the second embodiment illustrated in FIGS. 4, 5 and 6. In that embodiment, a wear pad assembly 36 comprises two projecting wear blocks 37*a* and 37*b* retained apart and locked in position in a recess 38 in the body 16 by a wedge block 39 which is very similar to the wedge block 21 of the first embodiment. The bolt and washer arrangement is the same and those components bear the same designations 18 and 23, as in the first embodiment. However, as illustrated, the hard surfaces 30 of the three blocks diminish in radius from axis of rotation A towards the leading end 41 of a wedge block rotation in respect of the boring direction of the drill string. Thus there is provided a surface for tamping or compacting loose soil rearwardly of the leading end 41.

However, there is provided a plurality of tipped cutters 44, the tips 45 of which comprise discs of polycrystalline diamond, and the leading cutters in respect of the boring direction of drill string rotation project further outwardly than the trailing cutters, but the faces of the tips 45 are inclined to provide a negative rake, which provides the most useful compromise in the cutters at that location. There are, however, only three cutters with the tips as shown in FIGS. 4, 5 and 6, and those are the top three cutters of the stabiliser tool, the lower six cutters being as described with respect to the first embodiment. This combination provides a means whereby the cutters can assist in the withdrawal of a drill string, particularly when it is associated with a curved drill hole, but also provides means where if the drill is used in soft earth, there is to some extent some tamping and consolidation of earth released by the cutters which reduces to some extent the degree of build up of earth between the body of the tool of this invention and a reamer assembly, thereby assisting to some extent in reducing the load applied to the drill string. Furthermore, the cutters remain effective even when rotation is reversed as can sometimes occur during withdrawal to facilitate removal of the drill string.

The claims defining the invention are as follows:

1. A drill string stabiliser tool comprising a body having an outer surface symmetrical about an axis of rotation, and a plurality of recesses extending inwardly from said outer surface and spaced in a helical configuration, said recesses each including opposite surfaces which diverge inwardly from said body outer surface, a plurality of pad assemblies in respective said recesses, each said pad assembly having a wedge block and at least one projecting wear block having one side abutted by the wedge block and on an opposite side surface complementally abutted by a said recess surface, said projecting wear block and each said wedge block having a relatively hard outer wear surface located radially outwardly from said body surface, and a bolt securing said wedge block to said body; and, said recesses and assemblies being oriented such that said recess opposite surfaces are transverse to forces generated by engagement of the respective wear surfaces with a bore hole surface when the tool is rotated in such bore hole.

2. A drill string stabiliser tool according to claim 1 wherein each said recess is symmetrical about a central radial plane of said body, and each said recess contains two said projecting wear blocks abutting opposite sides of a said wedge block, said wedge block opposite sides converging towards said axis of rotation.

3. A drill string stabiliser according to claim 1 wherein said projecting wear blocks are generally rectilinear in elevation, and side edges thereof are parallel in a plane normal to an axis of said bolt.

4. A drill string stabiliser according to claim 1 wherein each of some at least of said projecting wear blocks further comprise projecting hard tipped cutters.

5. A drill string stabiliser according to claim 4 wherein the hard tips of said cutters comprise polycrystalline diamonds.

6. A drill string stabiliser tool comprising:

a) a body having an outer surface symmetrical about an axis of rotation, and a plurality of recesses extending inwardly from said outer surface and spaced in a helical configuration, said recess surfaces including opposite surfaces which diverge inwardly from said body outer surface;

b) a plurality of pad assemblies in respective said recesses, each said pad assembly having a wedge block and at least one projecting wear block having one side abutted by the wedge block and on an opposite side abutted by a said recess surface;

c) each said projecting wear block and each said wedge block having a relatively hard outer wear surface located radially outwardly from said body surface, and a bolt securing said wedge block to said body;

d) each said recess being symmetrical about a central radial plane of said body, and each said recess containing two said projecting wear blocks abutting opposite sides of a said wedge block, said wedge block opposite sides converging towards said axis of rotation;

e) each said edge block containing surfaces defining a bolt hole extending from its said outer wear surface to a radially inner surface, slot surfaces extending transversely from a side of said wedge block defining a lateral slot which extending across said bolt hole; and, f) a U-shaped washer contained in said slot, and said bolt having a head bearing against said washer, accommodated in said slot, and accessible through said bolt hole from a said outer wear surface of said wedge block.

7. A drill string stabiliser tool comprising:

a) a body having an outer surface symmetrical about an axis of rotation, and a plurality of recesses extending inwardly from said outer surface and spaced in a helical configuration, said recess surfaces including opposite surfaces which diverge inwardly from said body outer surface;

b) a plurality of pad assemblies in respective said recesses, each said pad assembly having a wedge block and at least one projecting wear block having one side abutted by the wedge block and on an opposite side abutted by a said recess surface;

c) each said projecting wear block and each said wedge block having a relatively hard outer wear surface located radially outwardly from said body surface, and a bolt securing said wedge block to said body;

d) at least some of said projecting wear blocks being projecting hard tipped cutters; and, e) said hard tipped cutters are arranged in an array, the extent of projection of the cutters from a said block increases from the trailing end of said array to the leading end thereof, with respect to a boring direction of drill string rotation.

8. A drill string stabiliser tool comprising:

a) a body having an outer surface symmetrical about an axis of rotation, and a plurality of recesses extending inwardly from said outer surface and spaced in a helical configuration, said recess surfaces including opposite surfaces which diverge inwardly from said body outer surface;

b) a plurality of pad assemblies in respective said recesses, each said pad assembly having a wedge block and at least one projecting wear block having one side abutted by the wedge block and on an opposite side abutted by a said recess surface;

c) each said projecting wear block and each said wedge block having a relatively hard outer wear surface located radially outwardly from said body surface, and a bolt securing said wedge block to said body;

d) at least some of said projecting wear blocks being projecting hard tipped cutters; and, e) the hard tips of said cutters having a negative cutting rake when said body is rotated in a boring direction of drill string rotation.

9. A drill string stabiliser tool comprising:

a) a body having an outer surface symmetrical about an axis of rotation, and a plurality of recesses extending inwardly from said outer surface and spaced in a helical configuration, said recess surfaces including opposite surfaces which diverge inwardly from said body outer surface;

b) a plurality of pad assemblies in respective said recesses, each said pad assembly having a wedge block and at least one projecting wear block having one side abutted by the wedge block and on an opposite side abutted by a said recess surface;

c) each said projecting wear block and each said wedge block having a relatively hard outer wear surface located radially outwardly from said body surface, and a bolt securing said wedge block to said body;

d) at least some of said projecting wear blocks being projecting hard tipped cutters; and, e) only the uppermost of said projecting wear blocks comprise said projecting hard tipped cutters.

10. A drill string stabilizer tool comprising:

a) an elongate body adapted for rotation about a body axis;

b) the body including an outer surface including a plurality of spaced perimetral recesses arranged in a helical array;

c) a plurality of wear pad mechanisms each positioned in an associated one of the recesses;

d) each mechanism having spaced side surfaces each complemental with an associated side surface of the associated recess such that each mechanism together with its recess has a two spaced pairs of complemental side surfaces;

e) the surface pairs of each associated mechanism and recess tapering oppositely from the body surface to a base of the recess at small acute angles whereby to provide retention of each such mechanism in its associated recess;

f) each mechanism including a wear surface for drill string guiding engagement with a wall of a bore hole; and, g) the complemental surface pairs being position transversely of imaginary planes bisecting the body whereby forces applied to the mechanisms due to frictional engagement of the wear surfaces with a bore hole wall are applied transversely of the complemental surfaces.

11. The tool of claim 10, wherein the acute angles of the spaced surface pairs of each recess are equal and opposite.

12. The tool of claim 10, wherein the surface pairs taper away from the outer surface toward the recess base.

13. The tool of claim 10, wherein the mechanism includes a wedge block and at least one wear block.

* * * * *